US005570836A

United States Patent [19]

Tai

[11] Patent Number: 5,570,836

[45] Date of Patent: Nov. 5, 1996

[54] COIN COLLECTOR FOR AN AUTOMATIC DISPENSER

[75] Inventor: Seiichi Tai, Tokyo, Japan

[73] Assignee: Sanpou Lock Co., Ltd., Tokyo, Japan

[21] Appl. No.: 380,704

[22] Filed: Jan. 30, 1995

[30] Foreign Application Priority Data

Aug. 25, 1994 [JP] Japan ..... 6-200550

[51] Int. Cl.[6] ..... G07B 15/00

[52] U.S. Cl. ..... 232/16; 232/1 D; 232/15

[58] Field of Search ..... 232/1 D, 7, 15, 232/16

[56] References Cited

U.S. PATENT DOCUMENTS

| | | | |
|---|---|---|---|
| 368,502 | 8/1887 | Wherry | 232/16 |
| 3,333,764 | 8/1967 | Pennell | 232/15 |
| 3,353,743 | 11/1967 | Amundsen | 232/15 |
| 4,267,962 | 5/1981 | Domkowski | 232/15 |
| 4,359,184 | 11/1982 | Sciortino | 232/16 |
| 4,638,746 | 1/1987 | Ishigure | 232/15 |

FOREIGN PATENT DOCUMENTS

| | | | |
|---|---|---|---|
| 1934447 | 6/1969 | Germany | 232/15 |

*Primary Examiner*—Flemming Saether
*Attorney, Agent, or Firm*—Nikaido, Marmelstein, Murray & Oram LLP

[57] ABSTRACT

Disclosed is an improved coin collector to be set in an automatic dispenser. It comprises a coin bag member comprising a coin bag and a bag frame; and a cover member having first slot means to receive counter projection means of a stationary plate, which is fixed to the inside of the dispenser, a semicylindrical cover circumferentially rotatable about its pivot axles between opening and closing positions, second slot means to receive counter projection means of the bag frame, and a lock to fasten the coin bag member to the cover member. Use of the semicylindrical cover permits a compact design of the coin collector, and the semicylindrical cover is guaranteed to be free of inadvertent closing in setting the coin collector in the automatic dispenser.

4 Claims, 7 Drawing Sheets

COIN COLLECTOR FOR AN AUTOMATIC DISPENSER

BACKGROUND OF THE INVENTION

1. Field of the Invention

The present invention relates to an improvement in or relating to a coin collector to be detachably fixed to the inside of an automatic dispenser for collecting coins when put in the coin slot of the dispenser. Such a coin collector is responsive to the setting in the automatic dispenser for opening its coin-inlet and permitting collection of coins, and is responsive to removal from the automatic dispenser for closing its coin-inlet, thereby preventing taking out the stored coins therefrom without using a key to unlock and open the coin-inlet of the coin collector.

2. Description of Related Art

FIG. 25 shows a conventional coin collector, the cover of which has a rectangular lid 1 to close its opening or coin inlet 2. A rotatable thumb-piece 3 is adapted to move in an arc slot made in the cover plate for opening and closing of the lid when unlocked, and there is second lock means to permit taking out the stored coins from the coin collector.

The thumb-piece 3 and the lid 1 are designed to move in one and same plane, and accordingly their horizontal travelling distance is relatively long, preventing the compact designing of the coin collector. Also, it requires two locks for opening and closing the lid and for removing the coin bag from the coin collector. This is disadvantageous to reduction of the manufacturing cost. Also, disadvantageously it happens that the lid 1 is unlocked when the coin collector is subjected to shocks, and the undesired unlocking of the lid 1 in the coin collector may induce a danger of losing all money stored.

Sometimes, the coin collector is inadvertently set in the automatic dispenser without opening its coin-inlet, and then, coins cannot be collected. Such incident is liable to be a cause for malfunctions or failures in the automatic dispenser.

SUMMARY OF THE INVENTION

One object of the present invention is to provide an improved coin collector which can be designed to be compact, and is guaranteed to be free of the setting of the coin collector with its coin-inlet kept closed in the automatic dispenser.

To attain this object a coin collector to be detachably fixed to the inside of an automatic dispenser for collecting coins when put in the coin slot of the dispenser is improved according to the present invention in that it comprises: a coin bag member comprising a coin bag and a bag frame; and a cover member having first slot means to receive counter projection means of a stationary plate, which is fixed to the inside of the dispenser, a semicylindrical cover circumferentially rotatable about its pivot axles between opening and closing positions, second slot means to receive counter projection means of the bag frame, and a lock to fasten the coin bag member to the cover member.

The stationary plate may have at least one stud pin thereon; and the semicylindrical cover has a slot to permit the stud pin to travel in the slot when the cover member is slidably attached to the stationary plate, the slot having a shape to cause the semicylindrical cover to be brought to its opening position as the stud pin travels in the slot.

The cover member may have a latch mechanism responsive to removal from the automatic dispenser for closing and fastening the semicylindrical cover, thus preventing the semicylindrical cover from being opened by hand unless the cylindrical cover is unlatched by unlocking the lock; and responsive to the attaching of the cover member to the automatic dispenser for opening the cylindrical cover.

The stationary plate may have a rotatable thumb-lock to fasten the cover member to the stationary plate, thus permitting the cover member to be removed from the stationary plate by turning the thumb-lock to its opening position in place of unlocking the lock with an extra key.

The coin collector may have a double-lock unit responsive to removal of the coin collector from the stationary plate of the automatic dispenser, said double-lock unit comprising an auxiliary latch in addition to the latch to close and fasten the semicylindrical cover in double-locking way, and a bag latch which is operatively connected to the latch so as to lock the bag member by actuating the latch.

Other objects and advantages of the present invention will be understood from the following description of a coin collector according to one embodiment of the present invention, which is shown in accompanying drawings.

DESCRIPTION OF THE PREFERRED EMBODIMENTS

Figure 1:
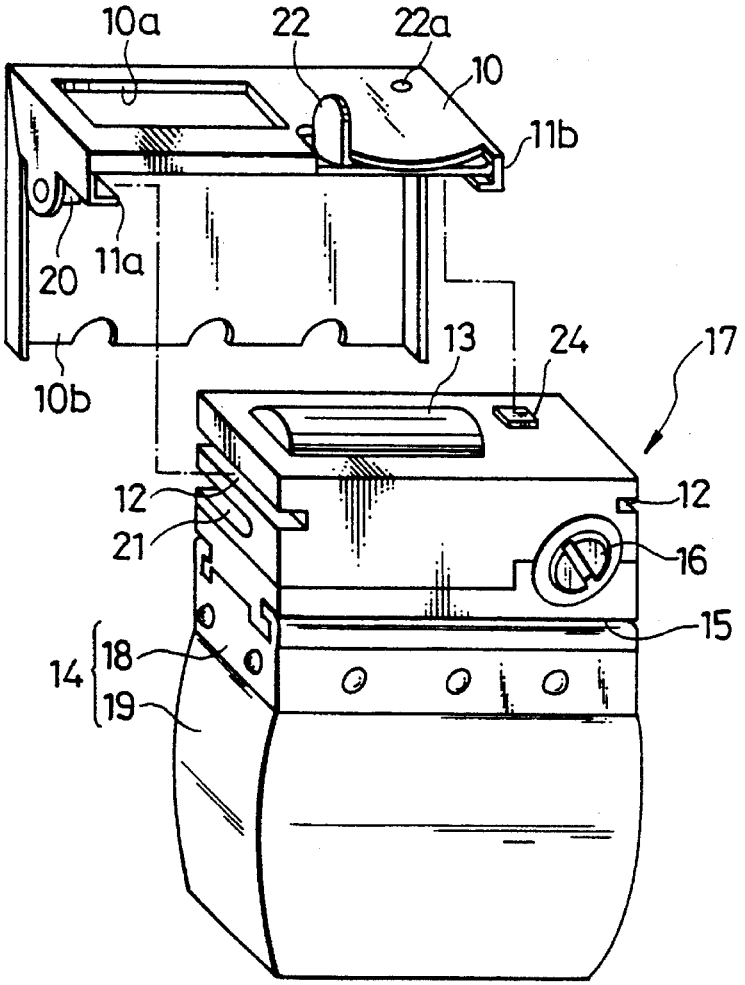
FIG. 1 is a perspective view of the stationary plate of an automatic dispenser and a coin collector according to the present invention, showing how the coin collector is attached to the automatic dispenser.

Referring to FIG. 1, a coin collector to be detachably fixed to the inside of an automatic dispenser for collecting coins when put in the coin slot of the dispenser comprises: a coin bag member 14 comprising a coin bag 19 and a bag frame 18; and a cover member 17 having first opposite slots 12 and 12 to receive counter projections of a stationary plate 10, which is fixed to the inside of the dispenser, a semicylindrical cover 13 circumferentially rotatable about its pivot axles 25 between opening and closing positions, a second slot is to receive the counter projection bars of the bag frame 18, and a lock 16 to fasten the coin bag member 14 to the cover member 17.

The stationary plate 10 has two guide rails 11*a* and 11*b* on its opposite sides, each having an inward projection to be inserted in either slot 12 of the cover member 17. Also, it has an opening 10*a*, and the semicylindrical cover 13 of the cover member 17 when attached to the stationary plate 10 will come to alignment with the opening 10*a* of the stationary plate 10. The guide rail 11*a* has a stud pin 20 thereon to be inserted in a slot 21 formed at the side of the cover member 17.

Figure 2:
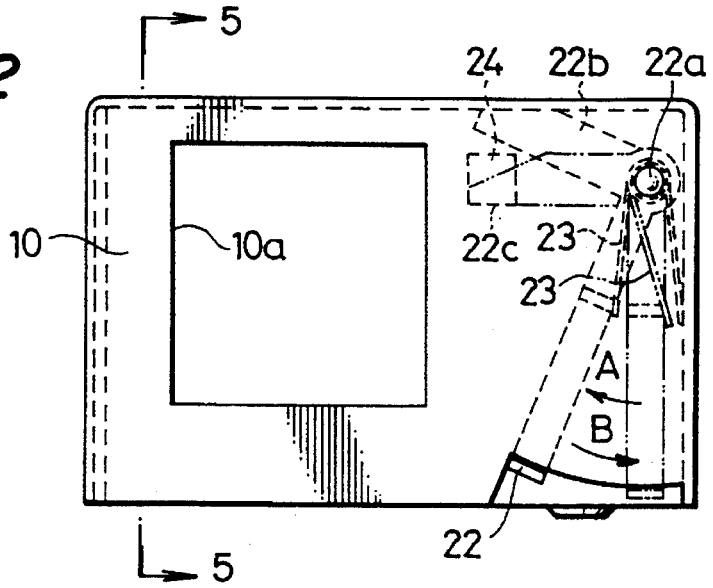
FIG. 2 is a top plan view of the coin collector.

As seen from FIG. 2, the stationary plate 10 has a rotatable thumb-lock to fasten the cover member 17 to the stationary plate 10. The rotatable thumb-lock has a rotatable thumb piece 22, which can rotate about its pivot 22*a*, and is biased by a spring 23 in the direction indicated by arrow A. When the thumb-piece 22 is rotated against the resilient force in the direction indicated by arrow B, its arm 22*b* abuts and pushes down a latch piece 24 by the abutting edge 22*c* for unlocking the cover member 17 from the stationary plate 10 as described hereinbelow, thus permitting removal of the coin collector from the automatic dispenser. Alternatively, the coin collector can be designed so as to lock and unlock the cover member 17 from the stationary plate 10 by using cam mechanisms associated with a lock 16, which is used to fasten the coin bag member 14 to the cover member 17. The stationary plate 10 has a stopper plate 10*b* at one end extending downward perpendicular to the guide rails.

Figure 6:
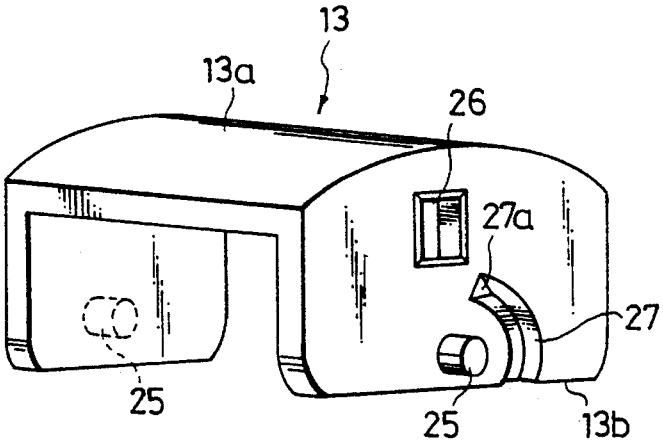
FIG. 6 is a perspective view of the semicylindrical cover.

The semicylindrical cover 13 having a semicylindrical surface 13*a* is rotatable about its pivots 25, as best seen from FIG. 6. The semicylindrical body has a latch hole 26 and a concentric arc slot 27 encircling the pivot 25 on one side 13*b*, and a bifurcate slot 28 on the other side as seen from FIG. 7. The bifurcate slot 28 is adapted to receive the stud pin 20 of the stationary plate 10, and the bifurcate slot 28 corresponds to the slot 21 of the cover member 17 in position, thereby allowing the stud pin 20 to invade the bifurcate slot 28 as the coin collector is attached to the stationary plate 10, and causing the semicylindrical cover 13 to rotate circumferentially until it is put in opening position. As seen from FIG. 7, a spring 29 is wound around the axle 25 to apply a biasing force to the semicylindrical cover 13 toward the closing position.

Also, the cover member 17 has a cover lock on one side, thereby preventing the opening of the semicylindrical cover 13 for wicked purpose after collecting all money from the coin collector. As seen from FIG. 24, a rotatable latch plate 42 is rotatably fixed to a pivot 41 with its first arm 42*a* in the path which the stud pin 20 follows, and with its second arm 42*b* caught by a stud pin 43 projecting from the cover member 17.

Figure 14:
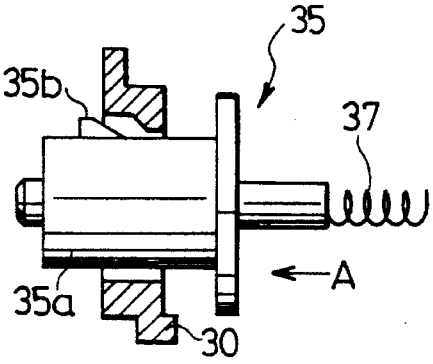
FIGS. 14 and 15 show how first and second cams work in the coin collector.

As seen from FIGS. 8 to 13, the lock 16 for fastening the coin bag member 14 to the cover member 17 has a second cam 35 biased by an associated spring 37 to abut the inner cylinder 16*a* of the lock 16. As seen from FIGS. 14 and 15, the shaft 35*a* of the second cam 35 is detachably engaged with a first cam 30 by the projection 35*b* of the cam shaft 35*a*. Normally, the second cam 35 is pushed by the spring 37 in the direction indicated by arrow A and the shaft 35*a* of the second cam 35 is decoupled from the first cam 30. When the second cam 35 is pushed by an elongated key 40 in the direction indicated by arrow B, the shaft 35*a* of the second cam 35 is coupled to the first cam 30 to rotate with it.

As seen from FIGS. 16 to 23, the first cam 30 is positioned with its first arm 30*a* detachably engaged with a lid latch 31, and with its second arm 30*b* detachably engaged with a bag latch 34. The lid latch 31 is movably fixed and is detachably engaged with the latch hole 26 of the semicylindrical cover 13. A rotatable sensor piece 32 can rotate about its pivot 33, and one end 32*a* of the rotatable sensor piece 32 is inserted in the arc slot 27, which is made in one side 13*b* of the semicylindrical cover 13 as described earlier. The sensor piece 32 is biased clockwise by a spring 32*c* wound around its shaft 33. The other end 32*b* of the sensor piece 32 is bent downward to be caught by the engagement projection 31*a* of the lid latch 31.

Now, the manner in which the so constructed coin collector works is described below.

Figure 3:
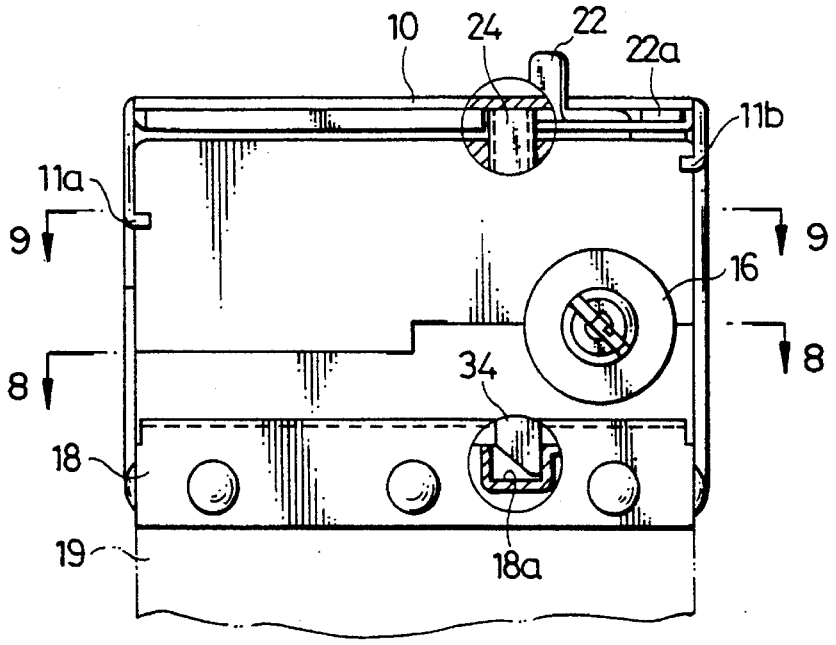
FIG. 3 is a front view of the coin collector, partly broken to show the inside.
Figure 4:
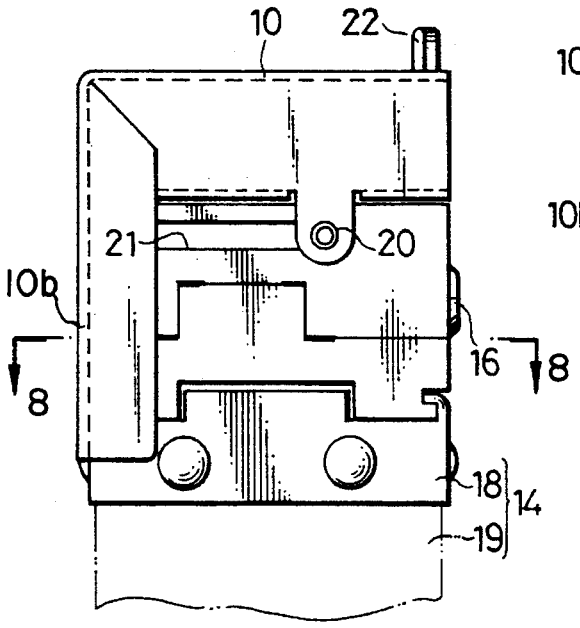
FIG. 4 is a left side view of the coin collector.

First, in removing the coin collector from the automatic dispenser a short extra key is inserted in the key slot of the lock 16, and then, the key is rotated to rotate cam mechanism (not shown) to pull down the latch 24 to unlock the coin collector from the stationary plate 10 (see FIG. 3). Alternately if the stationary plate 10 is equipped with a thumb lock for fastening the coin collector to the stationary plate 10 (FIGS. 2 and 3), the thumb-piece 22 may be turned in the direction indicated by arrow B to push down the latch 24 for unlocking.

Figure 5:
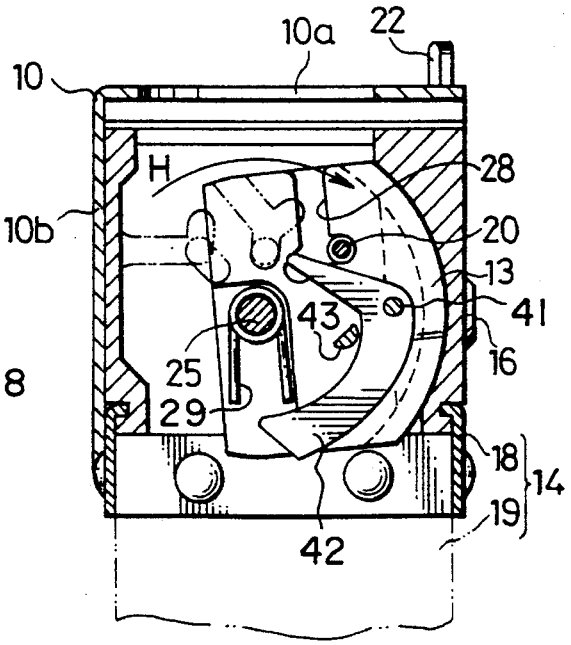
FIG. 5 is a longitudinal section of the coin collector showing rotational movement of a semicylindrical cover.
Figure 7:
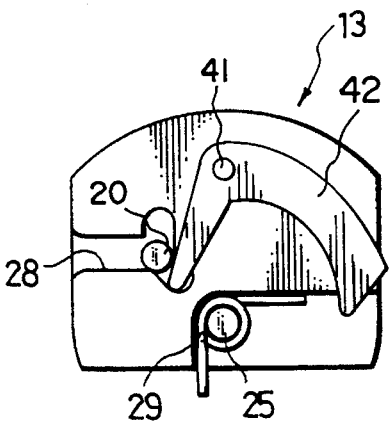
FIG. 7 is a left side view of the semicylindrical cover.
Figure 8:
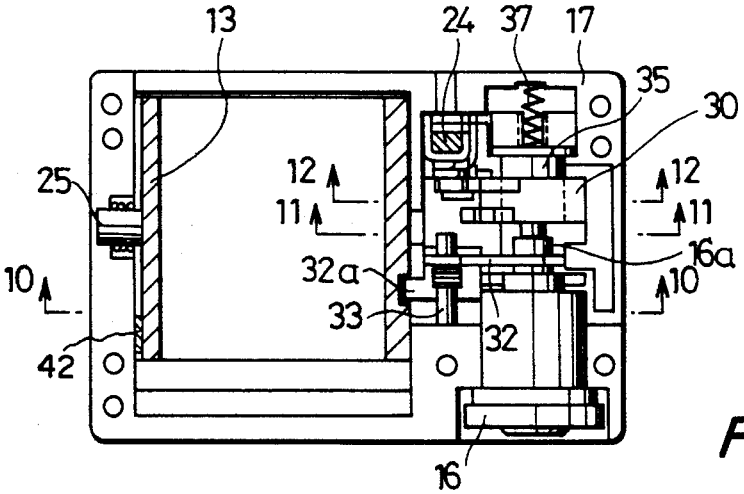
FIG. 8 is a plane view of the coin collector with a top panel removed therefrom and partly in cross section, thus showing the semicylindrical cover and associated mechanism.
Figure 9:
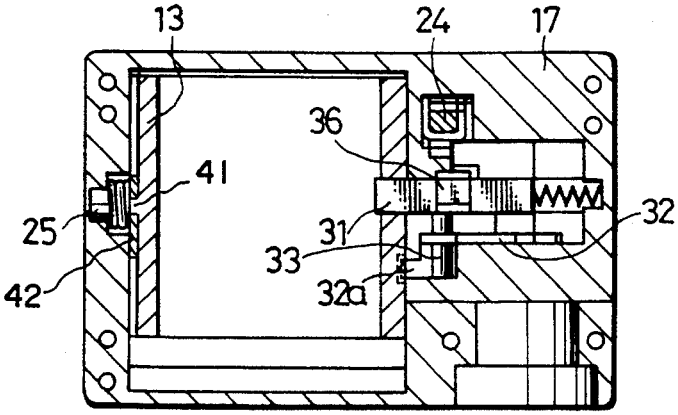
FIG. 9 is a cross section of the coin collector, showing different parts other than those of FIG. 8.
Figure 10:
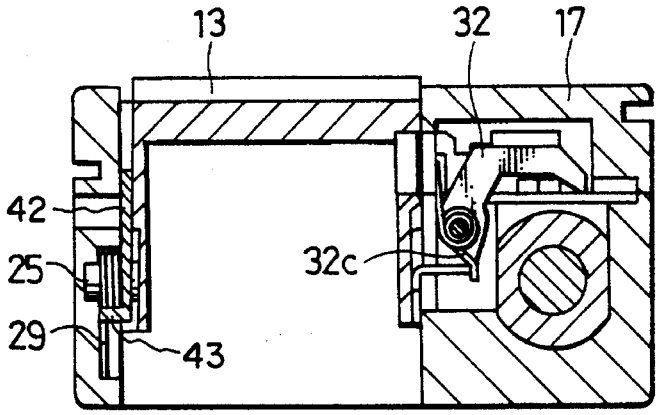
FIG. 10 is a section taken along the line 10—10 in FIG. 8.
Figure 11:
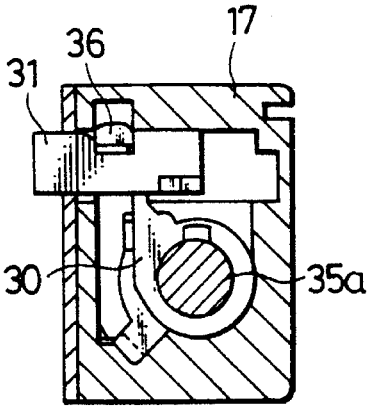
FIG. 11 is a section taken along the line 11—11 in FIG. 8.
Figure 12:
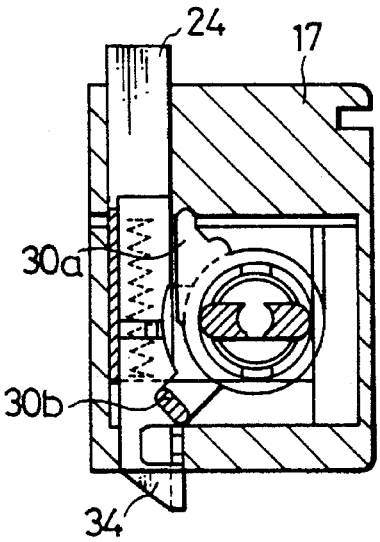
FIG. 12 is a section taken along the line 12—12 in FIG. 8.
Figure 13:
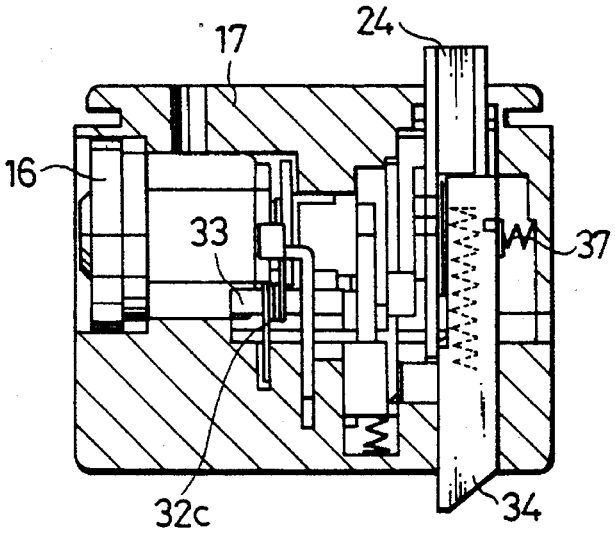
FIG. 13 is a longitudinal section of the mechanism associated with the semicylindrical cover.

Withdrawal of the coin collector from the automatic dispenser will cause the semicylindrical cover 13 to close through the agency of the pin 20 travelling in the bifurcate slot 28 under the resilient influence of the spring 29, as seen from FIGS. 5 and 7. When the semicylindrical cover 13 is brought to the closing position, the spring-biased lid latch 31 is caused to fall in the latch hole 26 on the one side of the semicylindrical cover 13, thereby locking the semicylindrical cover 13. At the same time the bent portion 36*a* of an auxiliary latch 36 gets in the recess of the lid latch 31, thereby preventing withdrawal of the lid latch 31, and the arm edge 31*d* of the lid latch 31 engages with the end 34*b* of the bag latch 34, thereby preventing the rising of the bag latch 34, which otherwise, could be caused by shocks. Thus, withdrawal of the coin collector from the automatic dispenser will cause automatic locking of the semicylindrical cover 13 for prevention of theft.

The semicylindrical cover 13 having the semicylindrical surface 13*a* is adapted to rotate about its pivots 25 (FIG. 6), and therefore, can be designed to be compact in the direction in which coins are thrown in, compared with the conventional flat lid.

Figure 15:
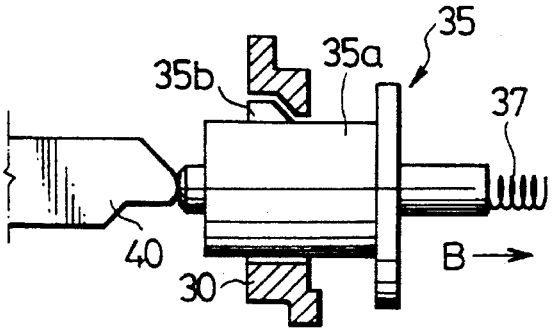
Figure 16:
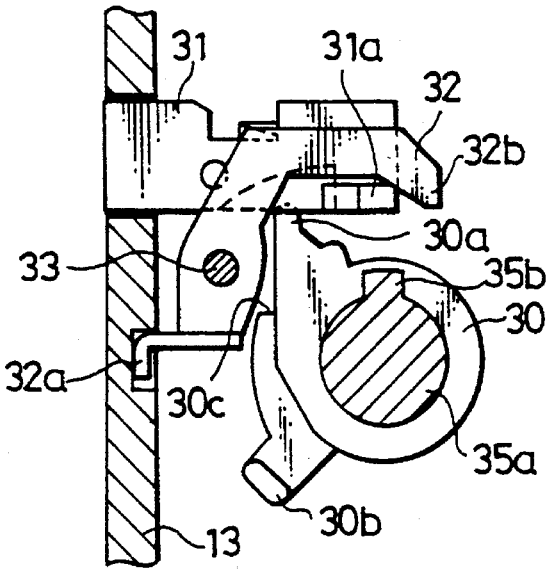
FIGS. 16, 17, 18 and 19 show how a second latch and a sensor piece work along with the first and second cams.
Figure 17:
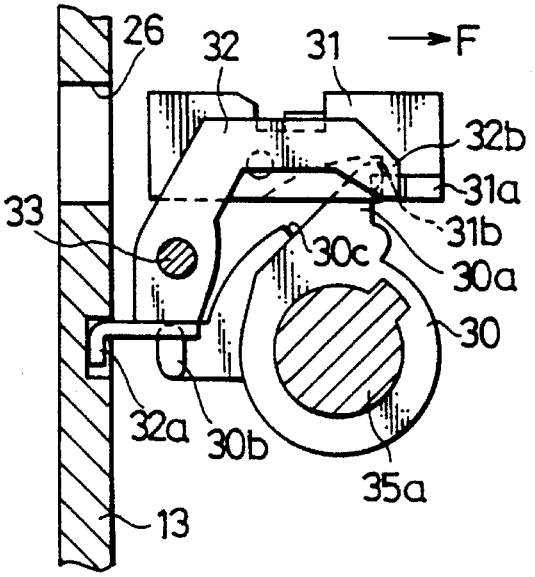
Figure 18:
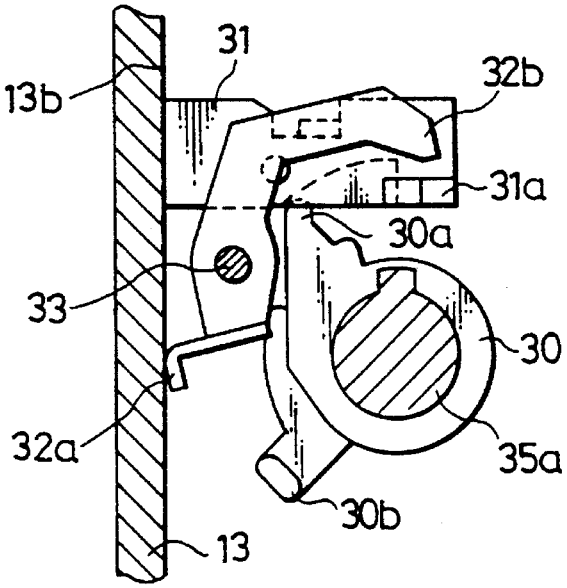
Figure 19:
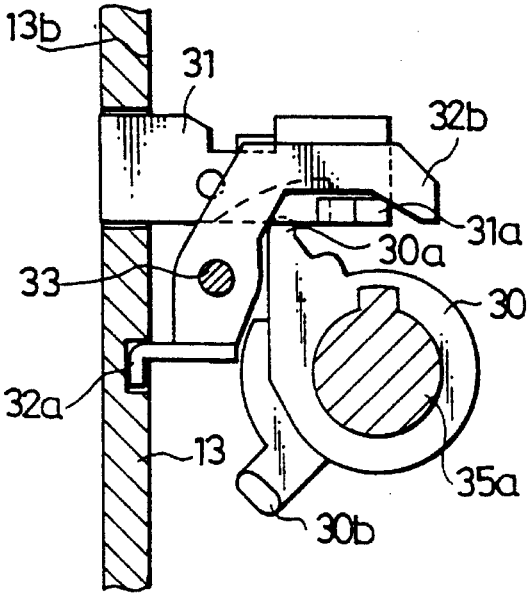
Figure 20:
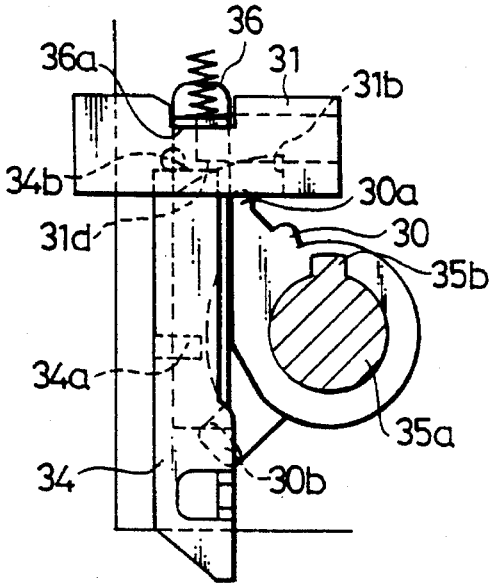
FIGS. 20, 21, 22 and 23 show how a locking plate and a third latch work along with the second latch and the first and second cams.
Figure 21:
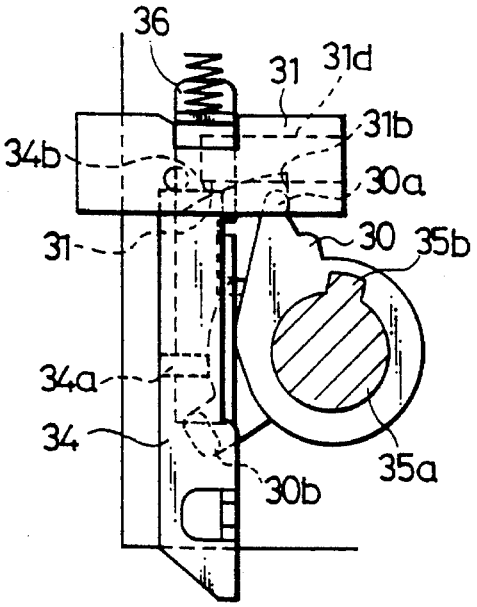

When the coin bag member 14 is removed from the cover member 17 to collect the coins from the coin bag 19, an elongated key 40 is inserted in the key hole of the lock 16 to push the second cam 35 backward against the spring 37 in the direction indicated by arrow B until the projection 35*b* of the second cam 35 fits in the first cam 301for engagement, as seen from FIG. 15. When the first and second cams 30 and 35 are coupled together, and when the key is rotated, the first cam 30 is rotated accordingly as seen from FIGS. 16 and 17. FIG. 16 shows the condition in which the first cam 30 is not rotated, thus locking the semicylindrical cover 13 with the latch 31.

The clockwise rotation of the extended arm 30*a* of the first cam 30 will cause withdrawal of the lid latch 31 in the direction indicated by arrow F as the extended arm 30*a* is caught by the curved recess 31*b* of the lid latch 31. The withdrawal of the lid latch 31 will unlock the semicylindrical cover 13, when the bent end 32*b* of the sensor piece 32 is caught by the engagement projection 31*a* of the lid latch 31, thus preventing the forward movement of the lid latch 31.

Figure 22:
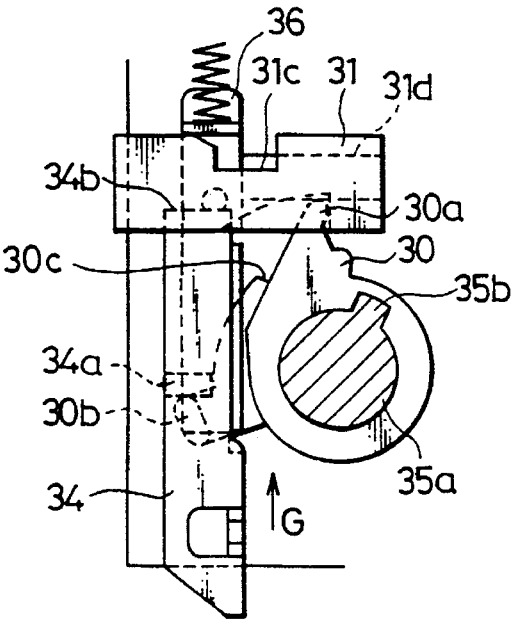
Figure 23:
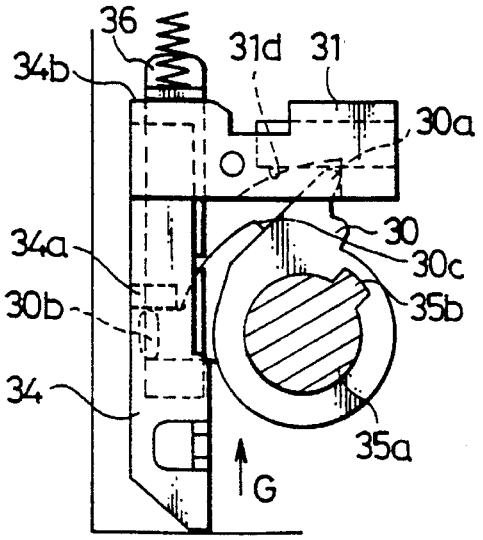

As seen from FIGS. 22 and 23, clockwise rotation of the first cam 30 will push up the bag latch 34 in the direction indicated by arrow G as the arm 30*b* of the first cam 30 is caught by the engagement projection 34*a* of the bag latch 34. As a result the coin bag member 14 is decoupled from the cover member 17, thereby permitting withdrawal of the coin bag member 14 along the second slot 15 of the cover member 17 for removal. Then, coins can be taken out from the coin bag 19.

Assume that after collecting the stored coins from the coin collector and before setting the coin collector in the automatic dispenser, the coin-inlet cover is opened by mischief. If this should happen, the coin-inlet cover is closed automatically under the resilient influence of spring for locking. To prevent such incident in a coin collector according to the present invention a lid lock as shown in FIGS. 24A to 24C is used to lock the semicylindrical cover 13 after collecting the stored coins from the coin bag 19.

Figure 24A:
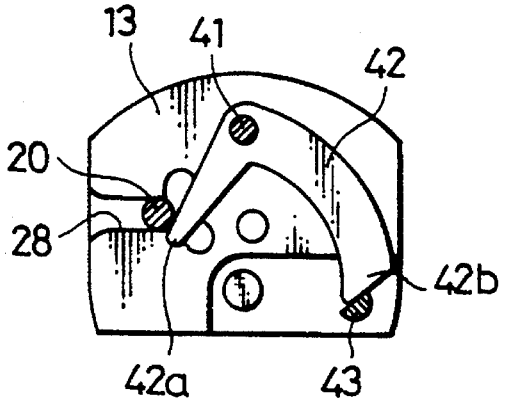
FIGS. 24A, 24B and 24C show how the semicylindrical cover is locked.

As seen from FIG. 24A, the first arm 42*a* of the rotatable latch 42 abuts on the stud pin 43 to prevent rotation of the semicylindrical cover 13 if the cover 13 is tried to be opened after collecting the stored coins from the coin bag 19.

When setting the coin collector in the automatic dispenser after collecting the stored coins from the coin bag 19, the bag frame 18 of the coin bag member 14 is attached to the cover member 17 by slidably inserting the projection of the bag frame 18 in the second slot 15 of the cover member 17. As the bag frame 18 is getting in, the bag latch 34 having a tapered end falls in the engagement recess 18*a* of the bag frame 18 against a spring (not shown) for locking. The cover member 17 having the coin bag member 14 thus integrally coupled is attached to the stationary plate 10 by slidably inserting the guide rails 11*a* and 11*b* of the stationary plate 10 in the first slots 12 of the cover member 17.

Figure 24B:
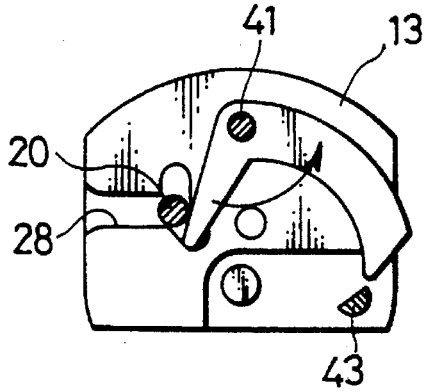
Figure 24C:
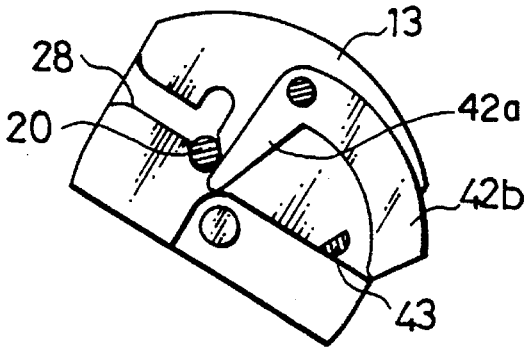
Figure 25:
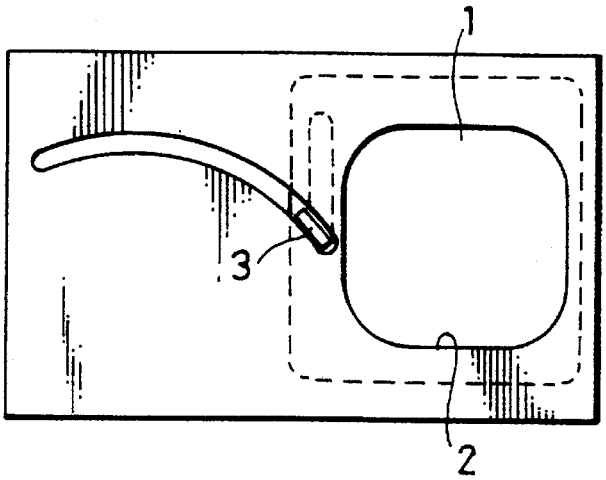
FIG. 25 PRIOR ART
FIG. 25 is a top plan view of a conventional coin collector.

When slidably inserting the guide rails 11*a* and 11*b* of the stationary plate 10 in the first slots 12 of the cover member 17, the stud pin 20 inwardly extending from the stationary plate 10 travels in the slot 21 to abut the first arm 42*a* of the rotatable latch 42 for counterclockwise rotation as indicated by arrow in FIG. 24B. Thus, the second arm 42*b* of the rotatable latch 42 is disengaged from the stud pin 43. After releasing the rotatable latch 42 the stud pin 20 moves to and fro along one branch of the bifurcate end of the slot 28 and then to the end of the other branch of the slot 28 as seen from FIG. 5. Thus, the semicylindrical cover 13 is rotated about its pivot axles 25 in the direction indicated by arrow H to open the coin inlet of the cover member 17. When the coin collector is attached to the stationary plate 10 of the automatic dispenser, the semicylindrical cover 13 is put automatically in opening position, thus preventing the inadvertent closing of the coin inlet in the automatic dispenser.

When the coin collector is set in the automatic dispenser, and when the semicylindrical cover 13 is put in opening position, one end 32*a* of the sensor piece 32 climbs over the slant end 27*a* of the arc slot 27 of the semicylindrical cover 13 (FIG. 6) to get out of the arc slot 27. As a result the other end 32*b* of the sensor piece 32 is disengaged from the engagement projection 31*a* of the lid latch 31, thus permitting the lid latch 31 to move forward as seen from FIG. 18. When the semicylindrical cover 13 is put in opening position, however, the lid latch 31 cannot be caught by the latch hole 26 of the semicylindrical cover 13, and therefore, the lid latch 31 abuts on the side 13*b* of the semicylindrical cover 13, so that it is ready to latching operation. Assume that the coin collector is removed from the automatic dispenser, and then the semicylindrical cover 13 is put in closing position, so that the lid latch is allowed to fall in the latch hole 26 for locking the semicylindrical cover 13.

As may be understood from the above, a coin collector according to the present invention uses a rotatable, semicylindrical cover 13, thereby permitting a compact design, compared with the reciprocating flat lid in the conventional coin collector. The setting of the coin collector in the automatic dispenser will cause the automatic opening of the cover, thus assuring that the coin inlet is not inadvertently closed in the automatic dispenser. Also, the coin collector can be designed so as to be coupled and decoupled from the stationary plate of the automatic dispenser by the alternative of the thumb-lock or the key-lock. Also, the multi-lock system used in the coin collector assures that the coin collector cannot be opened by hand after it is removed from the automatic dispenser or after all coins are collected from the coin bag.

I claim:

1. A coin collector to be slideably attachably and detachably fixed to an inside of an automatic dispenser having a coin slot for collecting coins when put in the coin slot of the dispenser, said coin collector comprising;

a coin bag member including a coin bag and a bag frame; and a cover member having first slot means receiving guide rail projection means of a stationary plate fixed to the inside of the dispenser when said cover member is slideably attached to the stationary plate, said stationary plate having at least one stud pin thereon, a semicylindrical cover having pivot axles and being mounted in said cover member and rotatable about said pivot axles between opening and closing positions, second slot means in said cover member to receive projection means of the bag frame, and a lock to fasten the coin bag member to the cover member, said semicylindrical cover having a bifurcate slot receiving the stud pin when said cover member is slidably attached to the stationary plate, said bifurcate slot having a shape such that said semicylindrical cover is rotated to the opening position as the stud pin travels in said bifurcate slot.

2. A coin collector according to claim 1, wherein the cover member has a latch mechanism responsive to removal of said cover member from the automatic dispenser for closing and fastening the semicylindrical cover and responsive to the attaching of the cover member to the automatic dispenser for opening the cylindrical cover.

3. A coin collector according to claim 2, further comprising a double-lock unit responsive to removal of the coin collector from the stationary plate of the automatic dispenser, said double-lock unit comprising an auxiliary latch in addition to the latch mechanism to close and fasten the semicylindrical cover in a double-locking way, and a bag latch which is operatively connected to the latch mechanism so as to lock the bag member by actuating the latch mechanism.

4. A coin collector according to claim 1, wherein the stationary plate has a rotatable thumb-lock to fasten the cover member to the stationary plate.

* * * * *